United States Patent [19]

Rooney et al.

[11] Patent Number: 4,463,804

[45] Date of Patent: Aug. 7, 1984

[54] VENTED NON-PRESSURIZED, UNCONTAMINATED WELL FLUID SAMPLER

[75] Inventors: Jack F. Rooney; William K. Cooper, both of Houston, Tex.; Stephen J. Papageorge, Wappingers Falls, N.Y.; Eugene L. Christ, Houston, Tex.

[73] Assignee: Texaco Inc., White Plains, N.Y.

[21] Appl. No.: 362,689

[22] Filed: Mar. 29, 1982

[51] Int. Cl.[3] ..... E21B 49/08

[52] U.S. Cl. ..... 166/165; 73/864.63; 166/264; 166/64

[58] Field of Search ..... 166/264, 165, 166, 167, 166/168, 169, 64; 175/59, 234, 235; 73/864.63, 864.65, 864.66, 864.67

[56] References Cited

U.S. PATENT DOCUMENTS

| | | | |
|---|---|---|---|
| 1,775,641 | 9/1930 | Haertl . | |
| 2,577,210 | 12/1951 | Ruska | 73/864.63 X |
| 2,667,223 | 1/1954 | Farris | 166/165 |
| 3,047,072 | 7/1962 | Peters et al. | 166/164 |
| 3,152,644 | 10/1964 | Perkins et al. | 166/165 |
| 3,426,847 | 2/1969 | Reardon | 166/150 |
| 3,527,298 | 9/1970 | Varty et al. | 166/162 |
| 4,037,477 | 7/1977 | Niskin | 73/864.67 X |
| 4,372,382 | 2/1983 | Rooney et al. | 166/264 |

FOREIGN PATENT DOCUMENTS

| | | | |
|---|---|---|---|
| 330317 | 6/1930 | United Kingdom | 166/165 |

*Primary Examiner*—Stephen J. Novosad

*Attorney, Agent, or Firm*—Robert A. Kulason; Jack H. Park; Henry C. Dearborn

[57] ABSTRACT

A method is disclosed for recovering a non-pressurized and uncontaminated fluid sample from deep in a well or the like in an elongated sampler having a sample chamber formed by valves at both ends thereof in a tubular housing for trapping the fluid sample therein comprising, (1) venting the trapped sample fluid from one of the end valves into the well having a vertical portion extending at a predetermined distance above the sample chamber for (1) preventing detrimental pressure to build-up and (2) contamination of the sample fluid during ascent to the surface. A mechanism for carrying out the above method is also disclosed.

4 Claims, 9 Drawing Figures

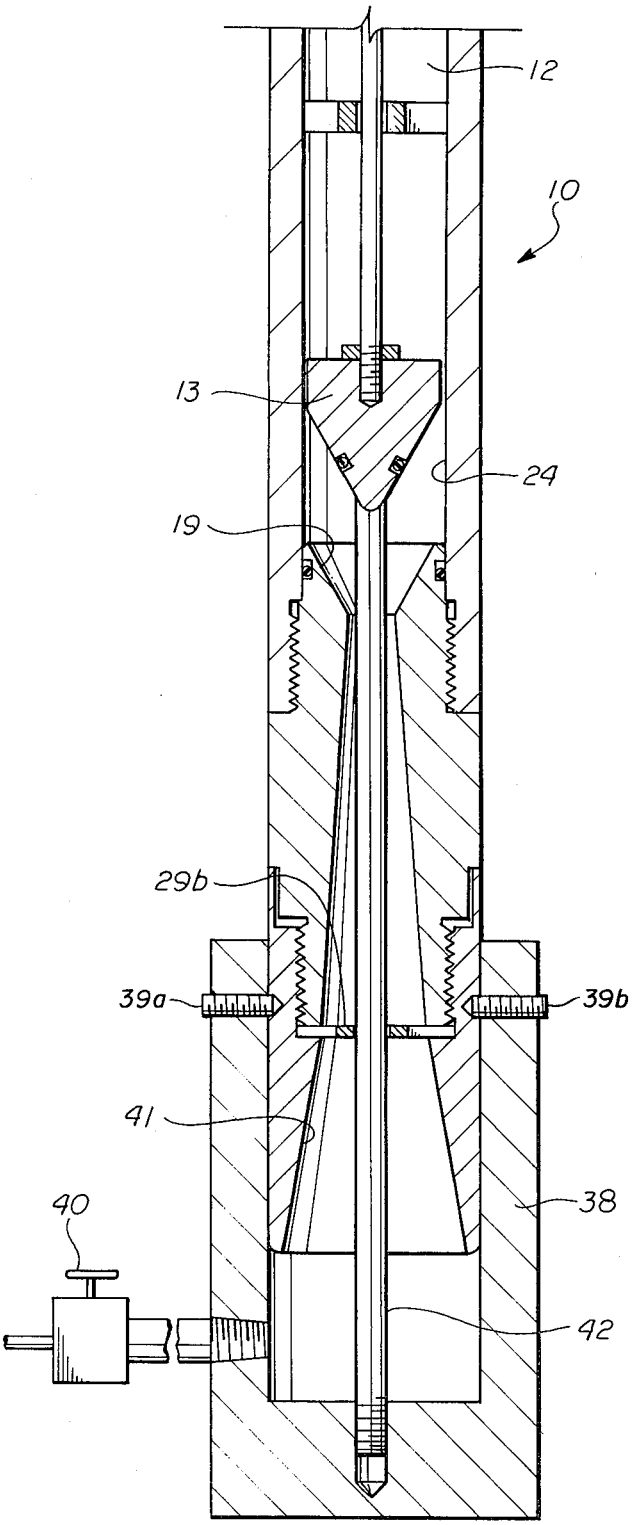
fig.1c
fig.5
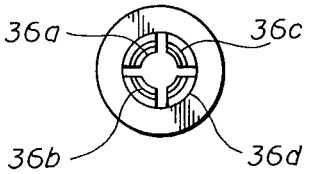
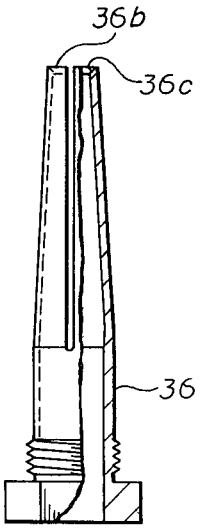
fig.4

VENTED NON-PRESSURIZED, UNCONTAMINATED WELL FLUID SAMPLER

BACKGROUND OF THE INVENTION

A current problem in secondary oil recovery through chemical injection is the need to obtain a representative downhole sample at a specific location. This problem arises from the need for a truly representative sample of produced fluids at a specific wellbore depth. Previous oil well samplers are not capable of accomplishing both of these requirements.

Likewise, very often a true, representative sample of the fluid in a well is desired but not necessarily obtained. A current problem in secondary oil recovery, for example, is the need for a sample of the injected polymer in an injection well at the depth of the intended injection interval. After this polymer has entered the formation and backflowed thereafter, it must be sampled without having its physical properties altered as it is lifted to the surface for analyzing and testing. An additional example is the need to sample polymer which has flowed through the oil bearing formation from the injection well to the producing well. This sample must also be obtained and lifted to the surface without altering its physical properties.

Various problems arise in obtaining the sample of the well fluid. First, the injection well fluid or polymer is stagnant and so the polymer must be made to flow into the sampler. Second, and most importantly, most polymers cannot be subjected to high shear rates which occur during high flow rates. Conventional bottom hole samplers enter the well with the sample chamber at atmospheric pressure and when opened in the wellbore at the formation depth will rapidly fill exposing the sample to very high shear rates. The high shear rates particularly alter the physical properties of the polymer and accordingly produce a nonrepresentative sample. The method and sampler disclosed herein provide a true and representative sample from the perforated interval, for example.

A sampler is desired, but seldom found, that provides a true representative sample of the well fluid at the exact depth desired. And one that ensures that no contaminant such as atmospheric air is introduced into the sample as is common.

Also, a non-pressurized sample is highly desired whereby high fluid pressure build-up is obviated and sudden release of the high fluid pressure on the operator removing the fluid sample from the sampler is prevented. This fluid pressure build-up in the sample chamber as it ascends from deep in the well to the surface is a serious hazard to sampler personnel.

OBJECTS OF THE INVENTION

Accordingly, a primary object of this invention is to provide a safe method of collecting a non-pressurized and uncontaminated sample of fluid from a well without changing its physical properties for providing a true, representative well fluid sample.

Another primary object of this invention is to provide a well fluid sampler that will carry out the above method of safely recovering a non-pressurized and uncontaminated fluid sample from a well or the like.

A still further object of this invention is to provide a well fluid sampler that has an elongated vent tube mounted externally on the sample chamber for providing an uncontaminated fluid sample and for providing less internal fluid drag in the chamber for improved and faster purging, filling, and emptying of the sample chamber.

Another object of this invention is to provide a sampler with elongated vent means connected to its upper valve for equalizing the pressure in the closed sampler chamber with that above the sampler for ensuring a non-pressurized and uncontaminated sample upon arrival at the surface.

A further object of this invention is to provide a well fluid sampler for collecting a non-pressurized and uncontaminated representative sample that is easy to operate, is of simple configuration, is economical to build and assemble, and is of greater efficiency for the collection of samples of such well fluid.

Other objects and various advantages of the disclosed sampler and method for collecting a true representative, non-pressurized, and uncontaminated sample will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, one form of the invention wherein like reference numerals designate corresponding parts in the several views in which:

FIG. 1*c* is a vertical section of the lower portion of the fluid sampler of FIGS. 1*a* and 1*b;*

FIG. 4 is a vertical view, partly in section of the latching mechanism slitted circular spring sheath per se; and FIG. 5 is a top view of the spring sheath of FIG. 4.

Figure 1A:
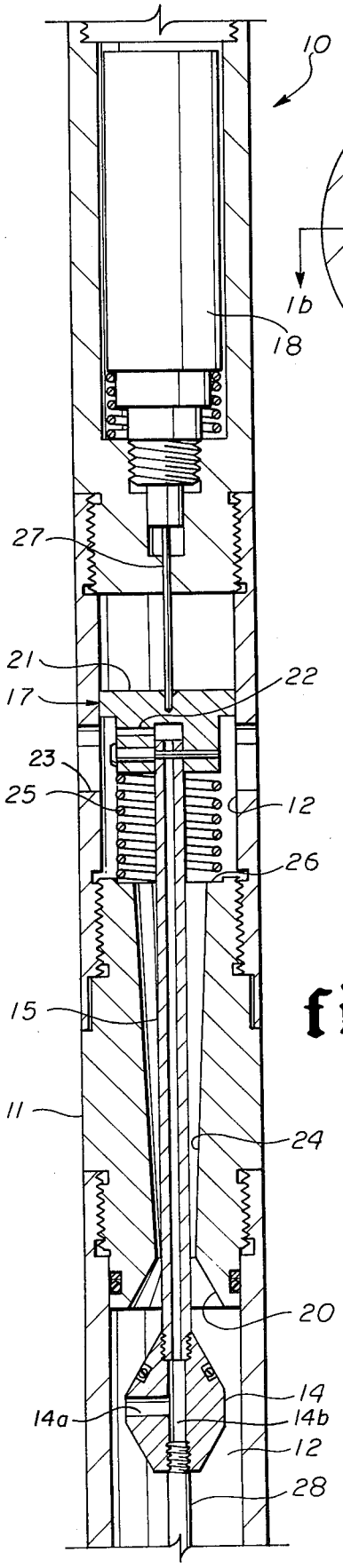
FIG. 1*a* is a schematic diagrammatic vertical sectional view of the upper portion of the new fluid sampler in the open position for being lowered in the well or for removing the sample fluid.
Figure 3:
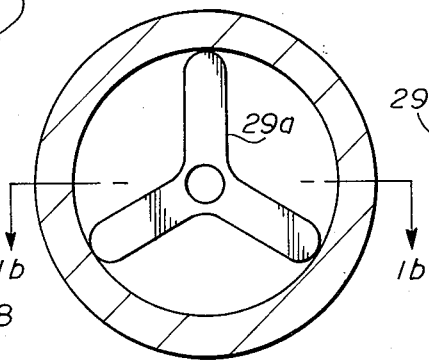
FIG. 3 is a section of FIG. 1*b* at 3—3.

The invention disclosed herein, the scope of which being defined in the appended claims is not limited in its application to the method steps disclosed herein or to the details of construction and arrangement of parts shown and described, since the invention is capable of being in the form of other embodiments and of being practiced or carried out in various other ways. Also, it is to be understood that the phraseology or terminology employed herein is for the purpose of description and not of limitation. Further, many modifications and variations of the invention as hereinafter set forth will occur to those skilled in the art. Therefore, all such modifications and variations which are within the spirit and scope of the invention herein are included and only such limitations should be imposed as are indicated in the appended claims.

DESCRIPTION OF THE INVENTIONS

This patent includes two inventions, a method for collecting a non-pressurized and uncontaminated sample of fluid from a well that is a true, representative well fluid sample, and a mechanism for practicing the above method.

METHOD FOR COLLECTING A NON-PRESSURIZED FLUID FROM A WELL

The basic method for collecting a non-pressurized and uncontaminated sample of well fluid in a sampler sample chamber (12, FIGS. 1*a*–1*c*) having interconnected upper and lower valves (14, 13) in upper and lower ends of the sample chamber comprises the step, (1) venting the trapped sample fluid from one of the valves to the well at a predetermined minimum distance from the sample chamber for preventing detrimental pressure build-up and contamination of the sample fluid during ascent to the surface.

A more detailed method for recovering a non-pressurized and uncontaminated fluid sample from deep in a well or the like to the surface comprises, (1) passing the well fluid through an elongated housing sample chamber having a lower inlet valve at one end and an upper outlet valve at the other end as the elongated housing is lowered in the well, (2) trapping the sample of well fluid in the sample chamber by closing both valves at the desired depth in the well, and (3) venting the trapped sample chamber well fluid from one of the valves through the elongated tube into the well for alleviating detrimental pressure build-up and contamination of the sample fluid in the sample chamber during ascent to the surface.

In the above method the second step may be further modified as follows:

(1) trapping the sample of well fluid in the sample chamber by moving both valves outwardly of the chamber to seat each in its valve seats whereby increased pressure internally of the sample chamber causes each valve to seat with increased pressure on its valve seat for improved sealing of the sample chamber.

The third method step of the above method may be expanded as, (1) venting the trapped sample chamber well fluid upwardly through a passage through the upper valve and then through the elongated tube to externally of the housing into the well for preventing contamination of the sample fluid in the sample chamber during ascent to the surface.

The last step of the above method may be expanded as, (1) venting the trapped sample chamber well fluid out from the one valve through at least a 5 inch long vent tube to externally of the housing for preventing contamination of the sample fluid in the sample chamber and detrimental pressure build-up during ascent to the surface.

THE PREFERRED EMBODIMENT FOR PRACTICING THE INVENTION SAMPLER FOR COLLECTING A WELL FLUID SAMPLE

The above methods for collecting a non-pressurized and uncontaminated sample of fluid from a well in a sampler sample chamber may be performed by other mechanisms than that disclosed in the FIGURES. The mechanism disclosed herein may be operated by other methods than those disclosed, as by hand. Also, the disclosed mechanism can be used to practice another and materially different method. However, the preferred system for performing the method is disclosed in FIGS. 1–6.

Figure 1B:
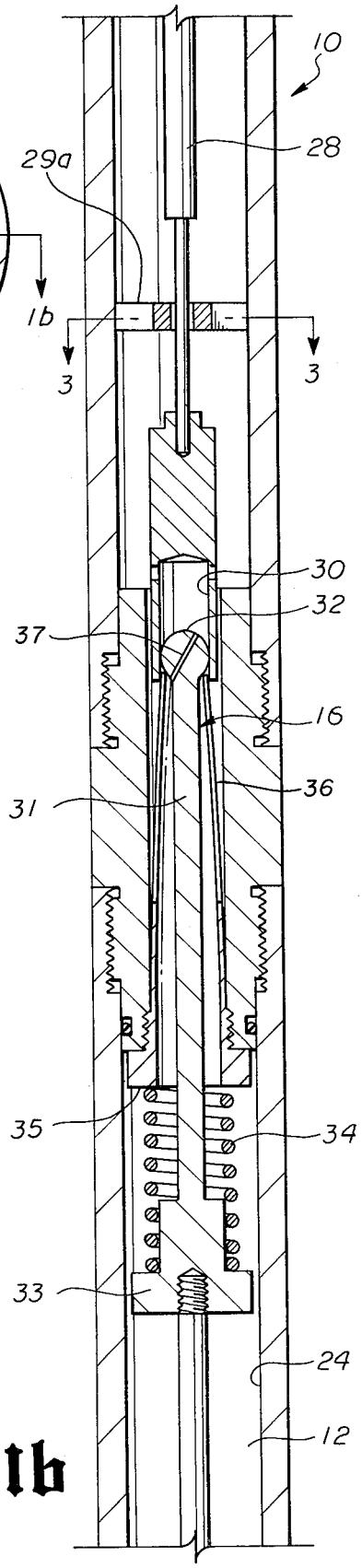
FIG. 1*b* is a vertical section of the middle portion of the fluid sampler of FIG. 1*a;*

A sampler 10, FIGS. 1*a*–1*c*, comprises an elongated housing 11 including a sample chamber 12 therein formed between a lower inlet valve 13 and an upper outlet valve 14 adjacent the respective lower and upper ends of the housing.

The principal feature of the sampler 10, FIG. 1*a*, is an elongated vent 15 connected to the upper outlet valve 14 and extending up internally of the sampler for a predetermined distance before exhausting out of the housing through exhaust opening 23 to the pressure in the well externally of the sampler. Thus, the vent 15 is always venting or relieving fluid pressure in the sample chamber 12 regardless of the depth. This prevents a build-up of fluid pressure in the pressure chamber after a fluid sample has been taken at extreme depths, and high pressures, and raised to the surface. The new vent 15 maintains atmospheric pressure when the well sampling personnel drains the fluid sample from the sampler and thus prevents any sudden release of fluid under high pressure.

Most important of all, this vent 15, FIG. 1*a*, of predetermined length prevents back flow of well fluids, whether gas or liquids, as far back as the sample chamber for thus always resulting in an uncontaminated fluid sample in the sample chamber. For a 5 foot (about 152 cm) long sampler having a diameter of substantially 1½ inches (about 4 cm), the vent 15 must have a length of no less than substantially 4 inches (about 10 cm) for a diameter of 1/16 inch (about 2 mm).

The valves 13 and 14, FIGS. 1*c* and 1*a*, respectively, are held open by their respective locking mechanisms 16, FIG. 1*b*, and 17, FIG. 1*a*, and all triggered closed in almost instantaneous, sequential action by clock 18 as described further hereinafter.

The lower end of the elongated vent 15, FIG. 1*a*, with the upper valve 14 connected thereto is guided upwardly and centered in its enlarged passage 12 in the housing by valve seat 20. The upper end of the elongated vent 15 ends with piston 21 attached thereto and is guided and centered in the same passages in housing 11, but moveable in an enlarged cylindrical portion thereof. A transverse channel 22 connects the end of the passage in the elongated vent 15 to a large exhaust opening 23 in the housing for venting the tube externally of the sample housing to the well. Likewise, when the valve 14 is not seated, a housing longitudinal channel 24 in the housing 11 provides ample room between the elongated tube 15 and the housing 11 therearound for fluid to pass from the sample chamber 12 up internally of the housing and out the large opening 23 to the well. A compression spring 25 is compressed between a shoulder 26 in the upper end of the housing in housing bore 24 and the adjacent side of the piston 21 attached to the upper end of the vent tube 15 for urging the vent tube upwardly for closing the upper valve 14. However, the valve 14 is held open against the closing forces of compression spring 25 by a pin 27 extending from the clock 18, whereby release of the pin by actuation of the clock allows the spring to expand suddenly for forcing the piston upwardly to close upper valve 14.

The lower locking mechanism 16, FIG. 1*b*, restrains the lower valve 13, FIG. 1*c*, from closing until actuation of the clock 18, FIG. 1*a*. A rod 28 extends down from upper valve 14, FIG. 1*a*, through a support guide 29*a*, FIG. 1*b*, to a sheath 30 internally of the housing longitudinal channel 24. An elongated rod 31 having an upper head 32 positioned in the sheath 30 extends down out of the sheath internally of the housing longitudnal bore 24 to terminate with a second and lower head 33. A compression spring 34 positioned between the lower head 33 and a shoulder 35 on the internal bore surface 24 tends to close lower valve 13.

A spring sheath 36, FIG. 1*b*, is rigidly secured, as with screw threads, inside the bore 24 of the housing 11. It has four spring legs, 36*a*, 36*b*, 36*c*, and 36*d*, FIG. 5, extending upwardly therefrom.

FIG. 4, a vertical view, partly section of the spring sheath 36, per se, illustrates at least portions of two spring legs 36*c* and 36*b* of the four total cut-away. FIG. 5, a top view of the sheath 36 removed from the sampler shows all four of the spring legs.

The sheath 30, FIG. 1*b*, is shown as being slid down over the rod head 32 and the four spring legs 36*a*–36*d* of the spring sheath 36. With the sheath 36 secured to the housing while the compression spring 34 tends to push rod 31 and it's head 32 downwardly, the four spring legs 36*a*–36*d* are held against the base of the head 32 by the sheath 30 for preventing downward movement of the head 32, rod 31, and lower valve 13.

With the valves 13 and 14 opened, fluid flow may pass throughout the length of the housing bore from bottom opening 41 past the lower valve 13, FIG. 1*c*, through the sample chamber 12, FIGS. 1*a*–1*c*, past and beyond the upper valve 14, and through the top opening 23, FIG. 1*a*, to the well outside of the sampler. A vent 37, FIG. 1*b*, through rod head 32 allows the fluid pressure throughout the chamber 12 to remain constant. This along with vent 15 maintains a non-pressurized sample chamber 12.

FIG. 1*c*, a vertical section of the lower portion of the fluid sampler 10, illustrates the sampler with the cap 38 attached to the bottom of the sampler with two screws 39*a*, 39*b*, or the like, after the sampler was removed from the well. With the two valves open, sample fluid is ready to be removed from the pet cock 40.

Briefly, in operation, after the clock 18 is set to trigger valve locking mechanisms 17 and 16 at a preset time, the two valves on each end of the sample chamber are opened and the sampler lowered in the well, or body of liquid, to the depth at which the fluid sample is desired. As the sampler is lowered in the well, the well fluid flows through the sampler until the sampler reaches the desired depth. Then after the preset time lapses, the valves are closed as triggered by the clock and the sampler raised to the surface.

The novel feature of the new vent makes this fluid sampler a non-pressurized sampler that provides an uncontaminated sample at the surface as explained hereinafter. While the conventional non-pressurized sampler vents its chamber directly to the well outside of the sampler, inventors have added two channels 14*a*, 14*b* through the upper valve 14, and an elongated vent 15 screwed onto the top of the upper valve of a precise minimum length. Then a transverse channel 22 is formed at the top of vent 15 to vent the fluid from vent 15 to exhaust opening 23, and from there to the well. This vent 15 is designed long enough to ensure any back flow from the well would never reach the sample chamber for thus always resulting in an uncontaminated fluid sample in the sample chamber 12. Thus, for a 5 foot (at least 152 cm) long sampler having a diameter of substantially 1½ inches (about 4 cm), the vent 15 must have a length from upper valve 14 to exhaust opening 23 of no less than substantially 4 inches (about 10 cm).

Figure 2A:
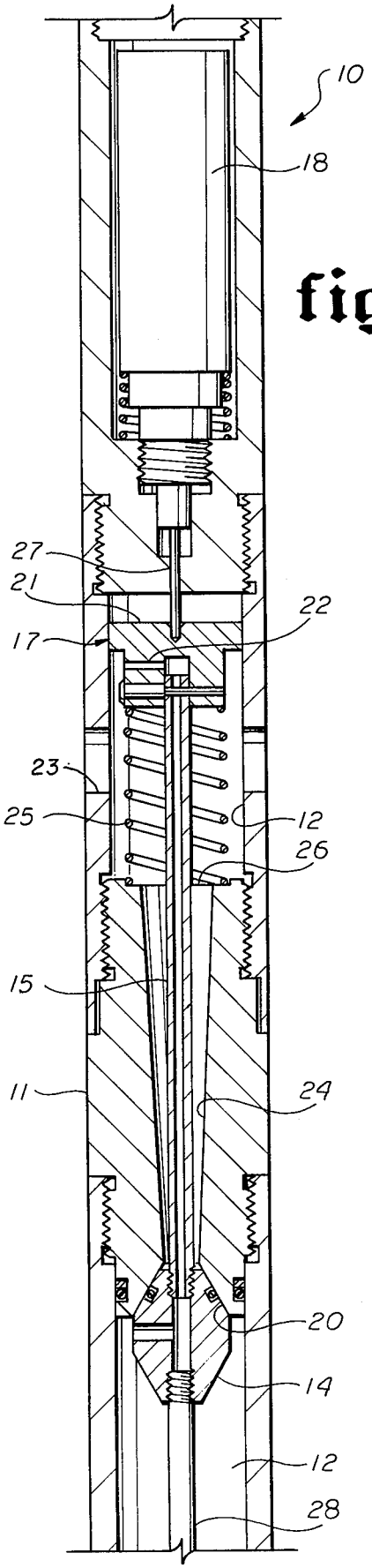
FIG. 2*a* is a vertical section of the fluid sampler of FIG. 1*a* in a closed position.
Figure 2B:
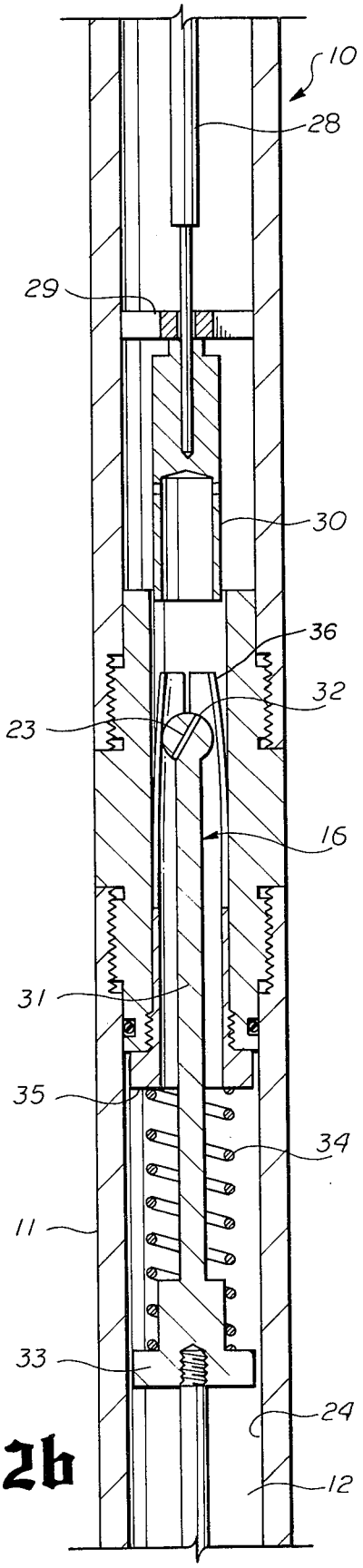
FIG. 2*b* is a vertical section of the fluid sampler of FIG. 1*b* in a closed position.
Figure 2C:
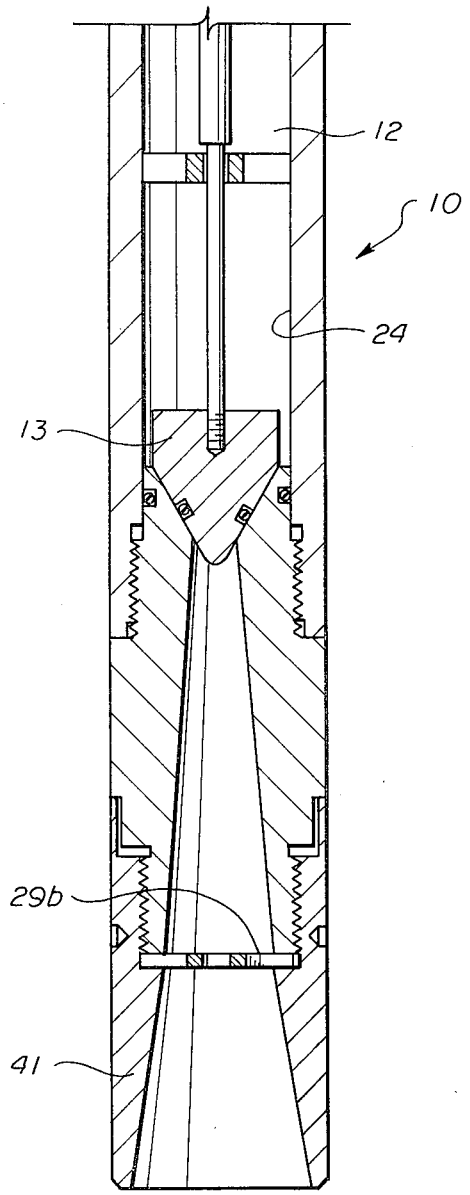
FIG. 2*c* is vertical section of the fluid sampler of FIG. 1*c* in a closed position.

After both valves snapped closed by action of the clock to trap the fluid in the chamber between the valves at that particular depth, the fluid sampler is then raised to the surface for recovery of the sample fluid. As the sampler is raised, openings or vents 41, FIG. 1*c*, 37 (FIG. 1*b*), horizontal vent 14*a*, vertical vent 14*b* (FIG. 1*a*), 15, 22 and 23 maintain well pressure in the sample chamber which is atmospheric at the surface to provide a non-pressurized sampler. Likewise, and most important, the elongated vent 15, FIGS. 1*a* and 2*a*, is formed at the precise, predetermined length for maintaining an uncontaminated fluid sample until drained out at the bottom through the pet cock 40, FIG. 1*c* after cap 38 with rod 42 therein is secured on the bottom opening 41 with screws 39 for opening the valve 13.

Accordingly, it will be seen that the disclosed vented, non-pressurized, uncontaminated well fluid sampler will operate in a manner which meets each of the objects set forth hereinbefore.

While only a few methods of the invention and one mechanism for carrying out the methods have been disclosed, it will be evident that various other methods and modifications are possible in the arrangement and construction of the disclosed sampler without departing from the scope of the invention and it is accordingly desired to comprehend within the purview of this invention such modifications as may be considered to fall within the scope of the appended claims.

We claim:

1. A non-pressurized, uncontaminated well fluid sampler comprising, (a) elongated housing means having a lower inlet valve means and an upper outlet valve means spaced apart for defining a sample chamber therebetween for being lowered in a well or the like for taking a sample of fluid, and (b) an elongated tube means extending from said upper outlet valve means when closed for providing an elongated fluid pressure vent means for venting the sample fluid pressure into the well at a predetermined distance above said sample chamber for preventing detrimental pressure build-up and contamination of said fluid in said sample chamber during ascent to the surface.

2. A non-pressurized and uncontaminated well fluid sampler as recited in claim 1 wherein, (a) said elongated tube means is at least substantially four inches long with a substantially 1/16 inch diameter for the prevention of contamination of the sample fluid.

3. A non-pressurized and uncontaminated well fluid sampler as recited in claim 1 wherein, (a) each valve means comprises a valve and a valve seat, each valve being moveable outwardly of the chamber to its valve seat whereby initial fluid pressure in the sample chamber tends to press each valve against its valve seat to maintain proper sealing.

4. A non-pressurized and uncontaminated well fluid sampler as recited in claim 1 wherein, (a) said outlet valve means has a bore therethrough for passing chamber fluid to said elongated vent means both when the outlet valve means is open and when closed for precluding any pressure build-up in the sample chamber and any contamination particularly when rising to the surface.

* * * * *